US009643039B2

(12) United States Patent
Andon

(10) Patent No.: US 9,643,039 B2
(45) Date of Patent: May 9, 2017

(54) TRAMPOLINES

(71) Applicant: Vuly Pty Ltd., Wakerley (QLD) (AU)

(72) Inventor: Joe Andon, Wakerley (AU)

(73) Assignee: Vuly Pty Ltd., Wakerley (QLD) (AU)

( * ) Notice: Subject to any disclaimer, the term of this patent is extended or adjusted under 35 U.S.C. 154(b) by 193 days.

(21) Appl. No.: 14/650,461

(22) PCT Filed: Dec. 3, 2013

(86) PCT No.: PCT/AU2013/001407
§ 371 (c)(1),
(2) Date: Jun. 8, 2015

(87) PCT Pub. No.: WO2015/100466
PCT Pub. Date: Jul. 9, 2015

(65) Prior Publication Data
US 2016/0303413 A1 Oct. 20, 2016

(51) Int. Cl.

| | |
|---|---|
| ***A63B 21/00*** | (2006.01) |
| ***A63B 5/11*** | (2006.01) |
| ***A63B 21/02*** | (2006.01) |
| ***A63B 71/02*** | (2006.01) |
| *A63B 71/00* | (2006.01) |

(52) U.S. Cl.
CPC ..... *A63B 5/11* (2013.01); *A63B 21/026* (2013.01); *A63B 71/022* (2013.01); *A63B 2071/0072* (2013.01)

(58) Field of Classification Search
CPC ..... A63B 21/02
USPC ..... 482/57, 28
See application file for complete search history.

(56) References Cited

U.S. PATENT DOCUMENTS

2014/0066259 A1* 3/2014 Andon ..... A63B 5/11 482/27
2014/0336005 A1* 11/2014 Miller ..... A63B 5/11 482/27

* cited by examiner

*Primary Examiner* — Jerome W Donnelly
(74) *Attorney, Agent, or Firm* — Abelman, Frayne & Schwab

(57) ABSTRACT

A trampoline including: a frame adapted to rest on the ground or be mounted on a plurality of spaced apart legs; a plurality of spaced apart flexible and resilient plates connected to said frame against relative movement therebetween and extending upwards therefrom; a jumping mat extending between said spaced apart flexible and resilient plates and being operatively connected at or adjacent its periphery thereto, said plates being arranged for movement inwards and outwards towards the opposite side of said mat in response to a user jumping on said mat; and plate support means operatively connected to said frame and arranged to engage said plurality of plates intermediate said frame and said mat.

12 Claims, 6 Drawing Sheets

TRAMPOLINES

This invention relates to trampolines. The invention has particular application to recreational trampolines but it may have application to sporting trampolines as well.

For many years recreational trampolines have typically included a tubular steel frame which is supported on spaced apart legs with a flexible jumping mat secured to the frame by a large number of spaced apart extension springs which extend and contract as a person jumps on the mat in order to give "bounce". The springs are usually connected to the tubular steel frame at one end via radial slots provided therein and to the mat via hooks or the like at the other end. Although trampolines can be made in many shapes, circular is probably the most popular in which case the frame is generally constructed of arcuate segments of round tube which are joined together in a spigot and socket arrangement with the end portion of one segment sliding into the end portion of the adjacent segment.

It will be appreciated that the space between the jumping mat and the frame creates some difficulties for users in getting onto the mat and when jumping on the mat the springs and the spaces therebetween can present some danger for anyone jumping too close to the edge of the mat. Consequently, modern playground trampolines typically include a padded safety barrier (or "padding") extending about the mat and covering the springs and the spaces therebetween. The padding is typically tied to the mat and/or the frame by ribbon ties or the like. Such trampolines typically include a safety barrier (or "net") extending about the mat frame and attached to posts upstanding therefrom to prevent users from falling off the trampoline.

Other forms of trampolines known as "soft edged trampolines" which do not require a frame about the edge of the jumping mat and do not use extension springs to support the mat have been developed in recent years. In such trampolines, the mat is typically supported on a large number of circumferentially spaced fibreglass rods which extend upwards, outwards and forwards around the mat from a frame under the mat and are connected to the edge of the mat at their upper ends. The rods are flexible and resilient so as to bend downwards and inwards as a person's weight comes onto the mat during jumping and to return to the original position as the weight comes off the mat causing a back and forth twisting motion of the mat. Such twisting action gives a different performance feel to users.

Co-pending application No. PCT/AU2012/000651 ("the PCT application") by the present applicant relates to another type of trampoline which does not require extension springs to secure the jumping mat to the frame. The PCT application is wholly incorporated herein by reference. The trampolines described in the PCT application incorporate a bottom frame from which a plurality of spaced apart flexible and resilient plates, preferably leaf springs, extend upwards and terminate in free upper ends to which a jumping mat is connected, the plates being arranged for movement inwards and outwards towards the opposite side of the mat in response to a person jumping on the mat.

While the trampolines described and illustrated in PCT application have been found to be very safe with very good performance characteristics the applicant has made significant improvements which are believed will improve the trampoline performance further, especially for larger trampolines while at the same time maintaining relatively low manufacturing costs.

With the foregoing in view, the invention in one aspect resides broadly in a trampoline including:

a frame adapted to rest on the ground or be mounted on a plurality of spaced apart legs;

a plurality of spaced apart flexible and resilient plates connected to said frame against relative movement therebetween and extending upwards therefrom;

a jumping mat extending between said spaced apart flexible and resilient plates and being operatively connected at or adjacent its periphery thereto, said plates being arranged for movement inwards and outwards towards the opposite side of said mat in response to a user jumping on said mat; and plate support means operatively connected to said frame and arranged to engage said plurality of plates intermediate said frame and said mat.

Preferably, said plate support means includes a rail spaced above said frame and secured thereto at spaced apart predetermined locations whereby the plate support means engages the plates against their respective inner faces. It is also preferred that each flexible and resilient plate be allowed to freely move against the support means. In a preferred form, said support means includes a continuous rail which is rigidly or semi-rigidly connected to said frame so as to provide a fulcrum about which each plate may pivot to at least a small extent while at the same time preventing or at least substantially inhibiting lateral movement of the plates towards the opposite side of the mat at the region of engagement. In such form, the plates are not connected to the rail but rather are allowed to freely move thereagainst. However, in some forms of the invention, locating means may be provided to prevent sliding movement of each plate against the rail. It is believed that engagement of the plate support means by each flexible and resilient plate in a free pivoting manner allows the plates to perform as a series of springs. In the case of there being one rail, it is believed that each flexible and resilient plate acts as a series of two springs with the upper portion acting as a first active element and the lower portion as a second active element. Advantageously, it will be appreciated that the plates can be selected to provide different performance characteristics. In a preferred form where each flexible and resilient plate is a leaf spring formed by laminating layers of spring steel with different numbers of layers at different locations, for example, three layers towards the lower end, two layers in the mid portion and one layer towards the upper end, it will be appreciated that the position of the rail may be selected so that the plate support means engages the plates at regions of higher or lower spring rate so as to obtain a desired mat performance. In another form of the invention, the support means may include multiple rails spaced one above the other and arranged to engage each plate at different positions along its length. It is believed that varying bounce characteristics may be obtained in such manner.

In a preferred form, where the plate support means is a rail, it is preferred that it be operatively connected to the frame via a sleeve in which it can be slidably fitted for ease of assembly. In such form, it is preferred that the sleeve be secured to a mounting member secured to and upstanding from the frame. In one such preferred form, the mounting member is a safety net pole which is connected to the frame.

Preferably, the flexible and resilient plates are sized so as to bend generally in only one direction, for example, in the case of a circular mat, the plates would only bend radially inwards and outwards, while in the case of a square mat the plates would bend directly towards the opposite side of the mat. In a preferred form, the plate comprises laminated elongate layers of spring steel over a substantial portion of its length. In one such form selected to meet desired rebound characteristics for the mat the plate comprises different numbers of layers at different places along the length of the plate.

Preferably, said spaced apart flexible and resilient plates are connected to said frame by passing through spaced apart slots formed in said frame, the slots being suitably sized to form a tight fit about the plates. In such form, it is preferred that retaining means be provided to retain the plates in the slots.

Preferably, the mat is connected to the flexible and resilient plates adjacent their upper ends by connector assemblies incorporating a hook and a load bearing fitting mounted in a pocket formed in the mat adjacent its periphery. In such form, it is preferred that the hook be connected at one end to the mat via the load bearing fitting and to the plates at the other end via one or more hook openings formed in the plate adjacent its upper end.

Preferably, the frame comprises a plurality of interconnected tubular segments suitably sized for transport of the trampoline in knock-down form. Advantageously, such segments are connected in a manner so as to prevent relative rotational or pivoting movement therebetween. In that respect, it is preferred that the frame segments include keying means for keying them together against relative rotational movement. In such form, it is also preferred that the plate support means be a rail as previously mentioned and that it also be made in segments suitably sized for transport in knock-down form. In such form of the invention it is preferred that the rail segments join by way of complementary inter-engaging male and female ends and that the segments join within the sleeves thereby hiding them for aesthetic appeal.

Terms such as "horizontal", "vertical", "upwards", "downwards", "above", "below" and similar terms as used herein are for the purpose of describing the invention in its normal in-use orientation and are not intended to limit the invention to any particular orientation.

In order that the invention may be more readily understood and put into practice, reference will now be made to the accompanying drawings, wherein.

Figure 1:
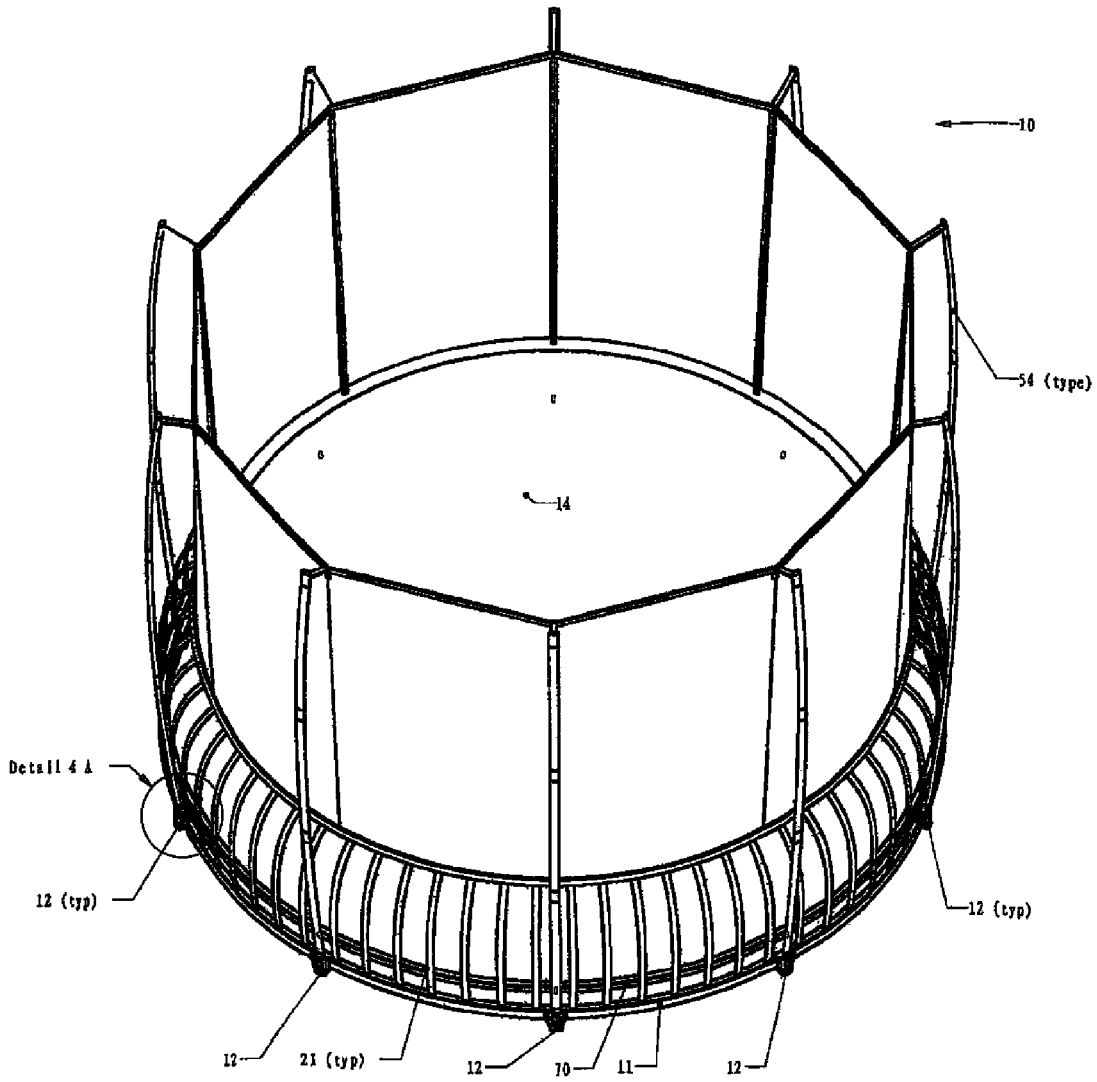
FIG. 1 is a pictorial representation of a trampoline from the front with a safety enclosure fitted according to the invention resting on a floor.
Figure 2:
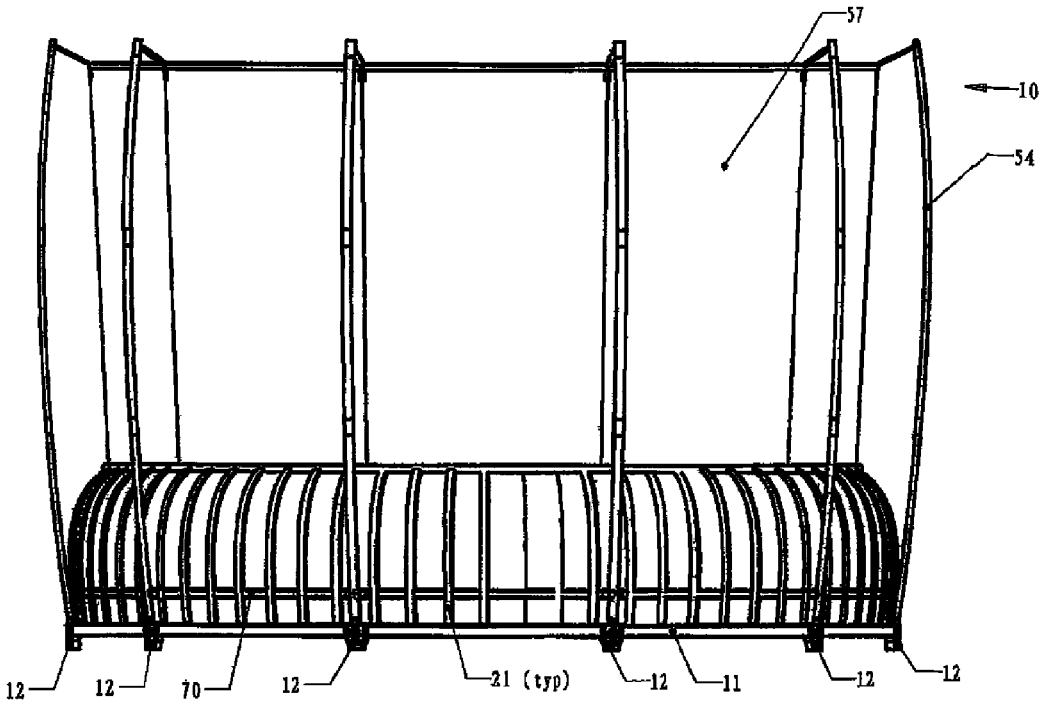
FIG. 2 is a pictorial representation of the trampoline of FIG. 1 tilted to show the upperside.
Figure 3:
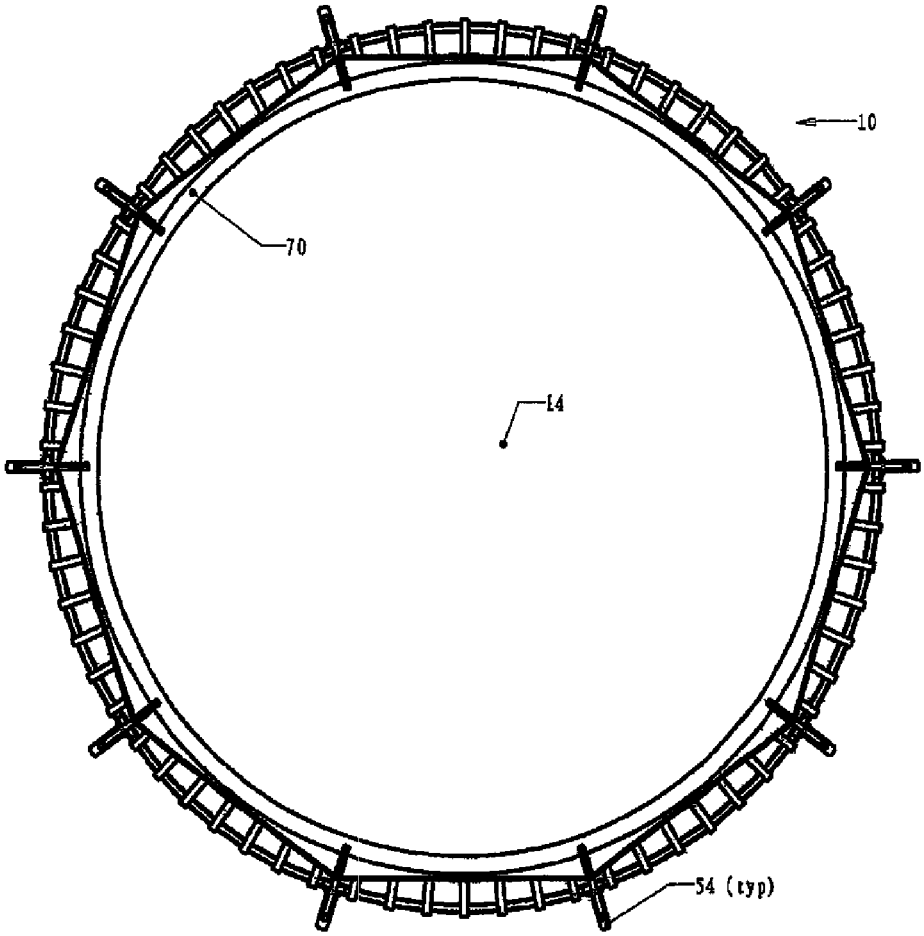
FIG. 3 is a view of the trampoline of FIG. 1 from above.

The trampoline 10 illustrated in FIG. 1 includes a slightly elevated circular bottom frame 11 constructed of interconnected rectangular hollow section steel tube arcuate segments which is supported on eight short angularly spaced legs 12 each of which is connected to the frame by opposed leg mounts 13 which are slidably mounted in the end portions of the arcuate segments. While the bottom frame in the embodiment shown is circular in cross section, other cross sectional shapes are also satisfactory, for example, round, oval, elliptical, square etc. Suitably, a jumping mat 14 is operatively connected to the frame 11 via Sixty-three equi-angularly spaced leaf springs 21 which extend upwardly and curve inwardly from the frame.

The lower ends of the leaf springs 21 are fitted in respective slots 22 in the bottom frame ii and parallel to the curved longitudinal axis of the frame in the manner described in relation to FIG. 41 to FIG. 49 of the PCT application and reference may be made to that application for a clear understanding of the general arrangement of the present trampoline and the mat 14 is connected at its periphery to the leaf springs 21 adjacent their upper ends by connector assemblies also as described in relation to the trampoline described and illustrated in relation to FIGS. 27 to 40 of the PCT application.

A safety net 51 extends fully about the mat 14 as can be seen in FIG. 1 and is supported by spaced apart posts 54 which are mounted to the respective feet 12 as described in the PCT application. The posts 54 are formed of steel tube and are rigidly connected to the feet 12 thereby forming a rigid safety frame to which the safety net can be flexibly connected.

Figure 7:
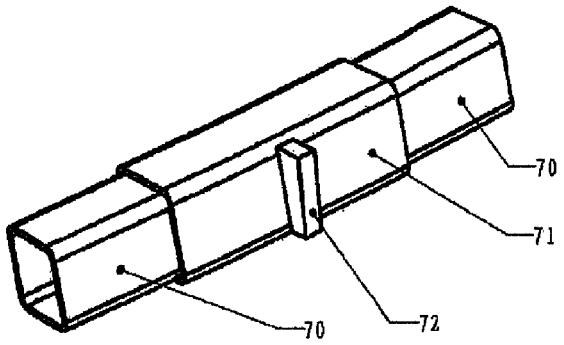
FIG. 7 is a pictorial representation of the mounting sleeve for the rail of the trampoline of FIG. 1.
Figure 8:
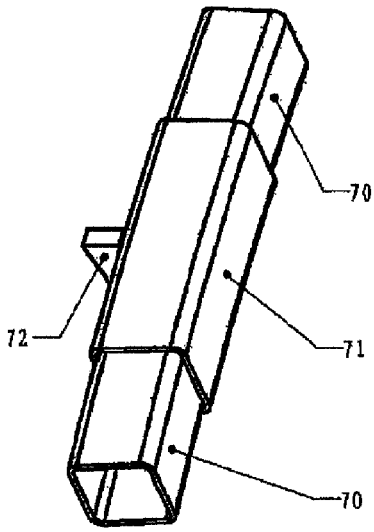
FIG. 8 is another view of the sleeve shown in FIG. 7.

A support rail 70 is mounted to the posts 54 via sleeves 71 which are mounted to the support posts between the bottom frame 11 and the mat. Advantageously, the support rail is circular and extends fully around the inside of the leaf springs above the bottom frame. As can be more clearly seen in FIG. 7, the sleeves are welded to their respective posts by a gusset 72 and consequently will move in and out towards the opposite side of the mat with any corresponding minor movement of the posts. As will be appreciated from FIGS. 7 and 8, for ease of assembly, the rail 70 is slidably mounted in the sleeves 71 and each rail segment ends midway through its respective sleeve. If desired, the rail could have an internal joiner or inter-engaging male and female ends.

Figure 4:
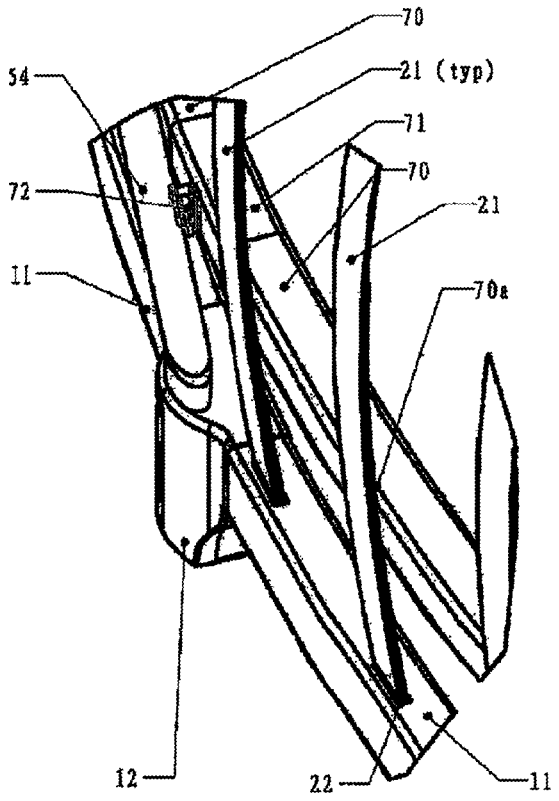
FIG. 4 is a blown up view of a portion of the trampoline shown in FIG. 1 as Detail 4.
Figure 5:
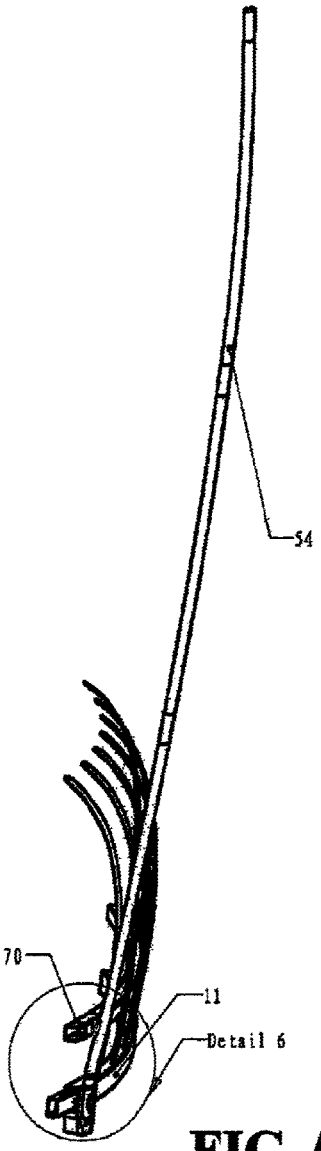
FIG. 5 is a sectional representation of part of the trampoline of FIG. 1 along a vertical plane adjacent a tent pole.
Figure 6:
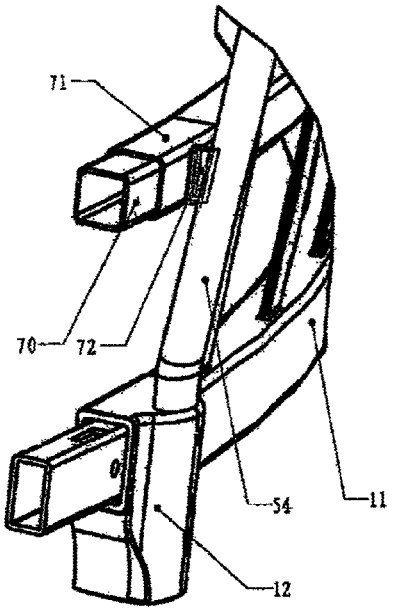
FIG. 6 is a blown up view of a portion of the trampoline of FIG. 1 shown as Detail 6.

It will be appreciated from FIG. 4 that the leaf springs 21 are not connected to the rail 70 but merely engage its outer face 70 by surface contact thereby allowing the leaf springs to freely move against the support means. Thus, the rail effectively acts as a fulcrum about which each plate pivots to a small extent as the mat moves up and down under the action of a person jumping thereon while at the same time preventing or at least substantially inhibiting lateral movement of the leaf springs towards the opposite side of the mat at the region of contact with the rail.

In some forms of the invention, lugs can be welded to the outer face of the rail to prevent or inhibit relative movement of the leaf springs along the rail, thus ensuring that the springs flex only towards and away from the opposite side of the mat.

It will be appreciated that the present embodiment incorporates a rail of rectangular hollow cross section. However, rails of circular, ovaloid, elliptical, square or other cross sections such as half circular would also be suitable. Further, even solid bar or rails made from other materials would be suitable to achieve the benefits of the invention as herein described.

The foregoing description has been given by way of illustrative example of the invention and many modifications and variations which will be apparent to persons skilled in the art may be made without departing from the spirit and scope of the invention as hereinbefore described.

The claims defining the invention are as follows:

1. A trampoline including:

a frame adapted to rest on the ground or be mounted on a plurality of spaced apart legs;

a plurality of spaced apart flexible and resilient plates connected to said frame against relative movement therebetween and extending upwards therefrom;

a jumping mat extending between said spaced apart flexible and resilient plates and being operatively connected at or adjacent its periphery thereto, said plates being arranged for movement inwards and outwards towards the opposite side of said mat in response to a user jumping on said mat; and plate support means operatively connected to said frame and arranged to engage said plurality of plates intermediate said frame and said mat.

2. A trampoline according to claim 1 wherein each flexible and resilient plate is allowed to freely move against said support means.

3. A trampoline according to claim 2 wherein said plate support means is arranged to at least substantially inhibit lateral movement of the plates towards the opposite side of the mat at the region of engagement.

4. A trampoline according to claim 1, wherein said plate support means is rigidly or semi-rigidly connected to said frame so as to provide a fulcrum about which each flexible and resilient plate may pivot.

5. A trampoline according to claim 4, wherein said plate support means includes a rail spaced above said frame and said rail provides a fulcrum about which each flexible and resilient plate may pivot.

6. A trampoline according to claim 5 wherein said rail is secured to said frame at spaced apart predetermined locations whereby it engages the plates against their respective inner faces.

7. A trampoline according to claim 6 wherein said rail is a continuous rail.

8. A trampoline according to claim 7 wherein said rail is connected to said frame via a sleeve in which said rail can be slidably fitted for ease of assembly.

9. A trampoline according to claim 8 wherein said rail comprises a plurality of interconnected segments.

10. A trampoline according to claim 9 wherein said rail segments are connected by said sleeves.

11. A trampoline according to claim 10 wherein said sleeve is secured to said frame via a mounting member secured to and upstanding from said frame.

12. A trampoline according to claim 11 wherein said mounting member is a pole supporting a safety net about the mat.

* * * * *